US008026820B2

(12) United States Patent
Nurmela et al.

(10) Patent No.: US 8,026,820 B2
(45) Date of Patent: Sep. 27, 2011

(54) METHOD AND SYSTEM FOR GUARDING A PERSON IN A BUILDING

(75) Inventors: Pasi Nurmela, Rovaniemi (FI); Sami Nurmela, Rovaniemi (FI)

(73) Assignee: Seniortek Oy, Rovaniemi (FI)

( * ) Notice: Subject to any disclaimer, the term of this patent is extended or adjusted under 35 U.S.C. 154(b) by 545 days.

(21) Appl. No.: 12/086,170

(22) PCT Filed: Dec. 4, 2006

(86) PCT No.: PCT/FI2006/050535

§ 371 (c)(1),
(2), (4) Date: Jun. 6, 2008

(87) PCT Pub. No.: WO2007/065970

PCT Pub. Date: Jun. 14, 2007

(65) Prior Publication Data

US 2009/0160660 A1 Jun. 25, 2009

(30) Foreign Application Priority Data

Dec. 9, 2005 (FI) ..... 20055658

(51) Int. Cl.
*G08B 23/00* (2006.01)

(52) U.S. Cl. ..... 340/573.1; 340/540; 340/556; 340/573.4; 600/595

(58) Field of Classification Search ..... 340/286.07, 340/573.1–573.4, 539.12–539.13, 523–565
See application file for complete search history.

(56) References Cited

U.S. PATENT DOCUMENTS

| | | | | |
|---|---|---|---|---|
| 4,598,275 | A * | 7/1986 | Ross et al. | 340/573.4 |
| 5,600,305 | A * | 2/1997 | Stafford et al. | 340/573.1 |
| 5,905,436 | A | 5/1999 | Dwight et al. | |
| 6,225,906 | B1 * | 5/2001 | Shore | 340/573.4 |
| 6,462,663 | B1 | 10/2002 | Wilson et al. | |
| 6,909,921 | B1 | 6/2005 | Bilger | |
| 7,307,523 | B2 * | 12/2007 | Kister et al. | 340/539.13 |
| 7,443,304 | B2 * | 10/2008 | Rowe et al. | 340/573.1 |
| 2003/0214420 | A1 | 11/2003 | Matsui et al. | |
| 2006/0055543 | A1 | 3/2006 | Ganesh et al. | |
| 2006/0058704 | A1 | 3/2006 | Graichen et al. | |
| 2007/0276202 | A1 | 11/2007 | Raisanen et al. | |

FOREIGN PATENT DOCUMENTS

| | | | |
|---|---|---|---|
| EP | 1324290 | A2 | 7/2003 |
| EP | 1 349 128 | A2 | 10/2003 |
| EP | 1 585 078 | A2 | 10/2005 |
| EP | 1906370 | A2 | 4/2008 |
| FI | 20040914 | | 1/2006 |
| GB | 2179186 | A | 2/1987 |
| GB | 2348725 | A | 10/2000 |
| WO | WO 03/044766 | A1 | 5/2003 |

* cited by examiner

*Primary Examiner* — Brent Swarthout
(74) *Attorney, Agent, or Firm* — Birch, Stewart, Kolasch & Birch, LLP

(57) ABSTRACT

The movement of persons is indicated at least at two predefined locations in a building with motion detectors intended for monitoring each location and fastened to the building. By means of the detections, the movement of each person is detected from a predefined initial location to a predefined destination location in a predefined time without raising an alarm if the detected locations of the person form a line of predefined consecutive locations. Otherwise, an alarm is raised.

10 Claims, 5 Drawing Sheets

Figure 1:
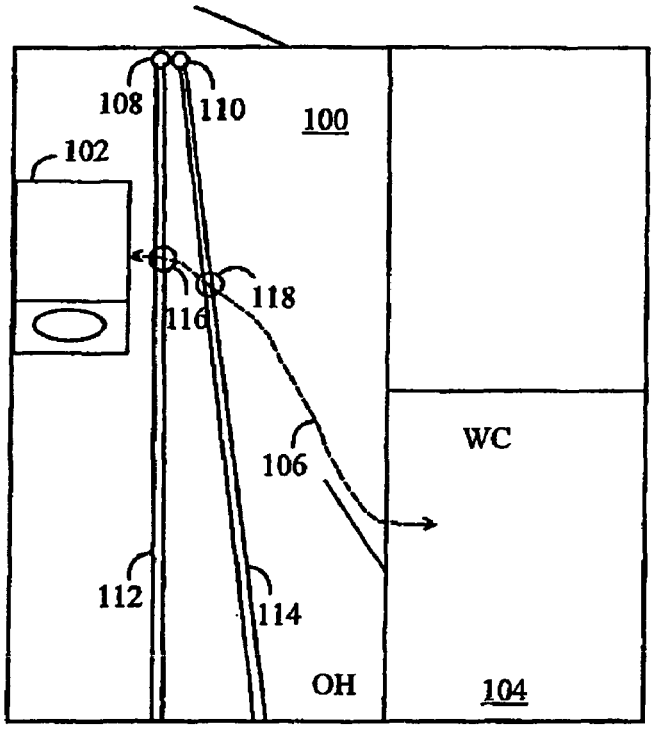

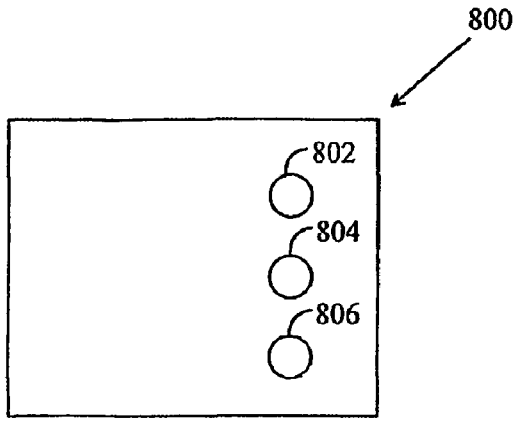
FIG. 8
| ROOM | M | O | ALARM |
|---|---|---|---|
| 300 | X | | |
| 301 | X | | |
| 302 | X | | |
| 303 | X | | |
| 304 | | X | |
| 305 | X | X | ALARM! |
FIG. 9
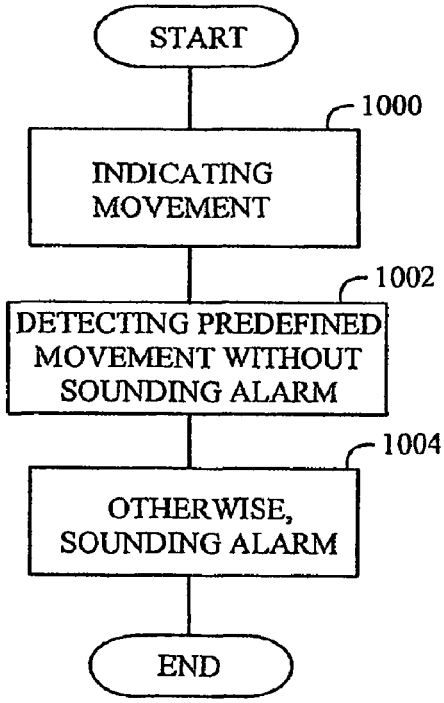
FIG. 10

METHOD AND SYSTEM FOR GUARDING A PERSON IN A BUILDING

FIELD

The invention relates to a method and system for guarding a person in a building.

BACKGROUND

The movements of people suffering from dementia or mental disorders in hospital buildings, nursing institutions, service homes, their wards or in corresponding premises can be monitored by means of a wristband attached to the person's wrist. The wristband may have a wireless radio connection to base stations in the building, which may be part of an exit and access control system. A display in a control room of the system may show the ongoing situation in the building by means of a graphical representation. The system may alert the control room, if someone removes the wristband from his or her wrist, tries to open a door, the opening of which is prohibited to him or her, or tries to use an elevator, the use of which is prohibited to him or her. The control room can inform the personnel of the institution in general, where the alarm has been triggered and, depending on the characteristics of the wristband, possibly also who has triggered the alarm.

However, there are problems involved with this type of control system. Having the wristband on the wrist or in some way with you all the time is not very comfortable for the person being monitored, and many refuse to use it, or try to take it off as soon as possible. In some cases, taking the wristband off may be necessary due to treatment or some other reason, and if the person being monitored forgets to put is back on the wrist, s/he may unintentionally wander outside or enter forbidden locations without anybody realizing it. A reliable operation of the system is also hampered by the fact that maintaining the charge of dozens, even thousands, of wristband batteries or accumulators at a sufficient level all the time is extremely difficult, or even impossible, and the nursing staff uses a lot of time in replacing the batteries or charging the accumulators.

BRIEF DESCRIPTION

It is an object of the invention to provide an improved method and a system implementing the method. This object is achieved by a method for guarding one or more persons inside a building. The method comprises directing, by means of at least two motion detectors fastened to the building, into a room being monitored at least two non-superimposed beams, at least one of which extends in a width of at most dozens of centimeters across the room being monitored; detecting the movement of each person at least at two locations defined by the beams; observing the movement of each person by means of the detections in a predefined time without raising an alarm, if the detected locations of the person form a line of predefined consecutive locations from a predefined initial location to a destination location, and raising an alarm if this is not the case.

The invention also relates to a system for guarding one or more persons inside a building. The system comprises at least two motion detectors and a control centre; each motion detector is fastened to the building and configured to direct into a room being monitored at least two non-superimposed beams in such a manner that at least one motion detector is configured to extend its beam in a width of at most dozens of centimeters across the room being monitored; each motion detector is configured to detect the movement of each person at least at two locations defined by the beams; the control centre is configured to observe the movement of each person by means of the detections in a predefined time without raising an alarm, if the detected locations of the person form a line of predefined consecutive locations from a predefined initial location to a destination location, and the control centre is configured to raise an alarm if this is not the case.

Preferred embodiments of the invention are disclosed in the dependent claims.

The method and system of the invention provide several advantages. The solution minimizes costs and the number of equipment. The people being monitored need not carry a wristband or any other device with them, and the monitoring system is inconspicuous. At the same time, the operation of the system is independent of the necessary but inconvenient accumulators or batteries in the wristbands.

LIST OF FIGURES

Figure 2:
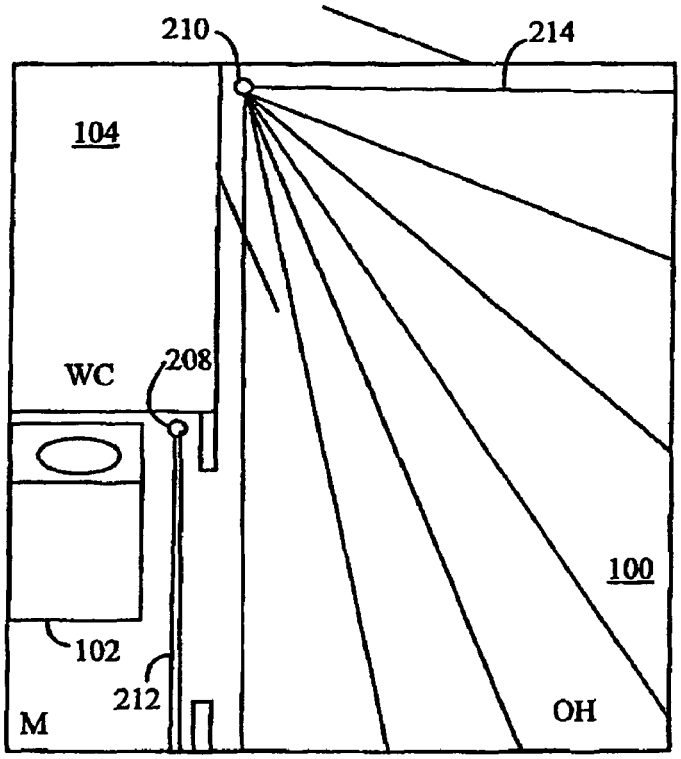
Figure 3:
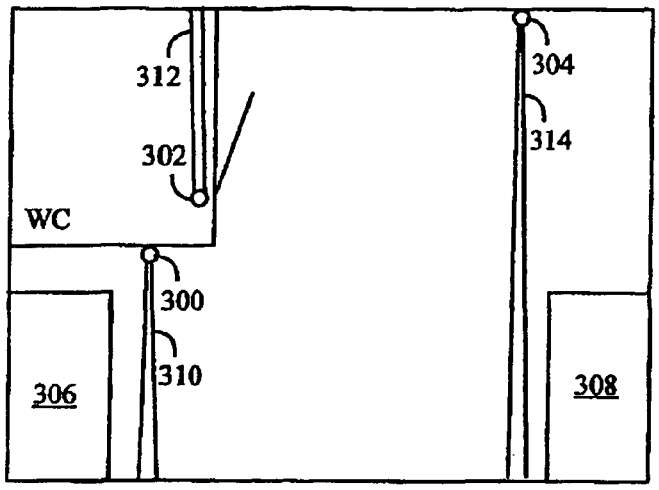
Figure 4:
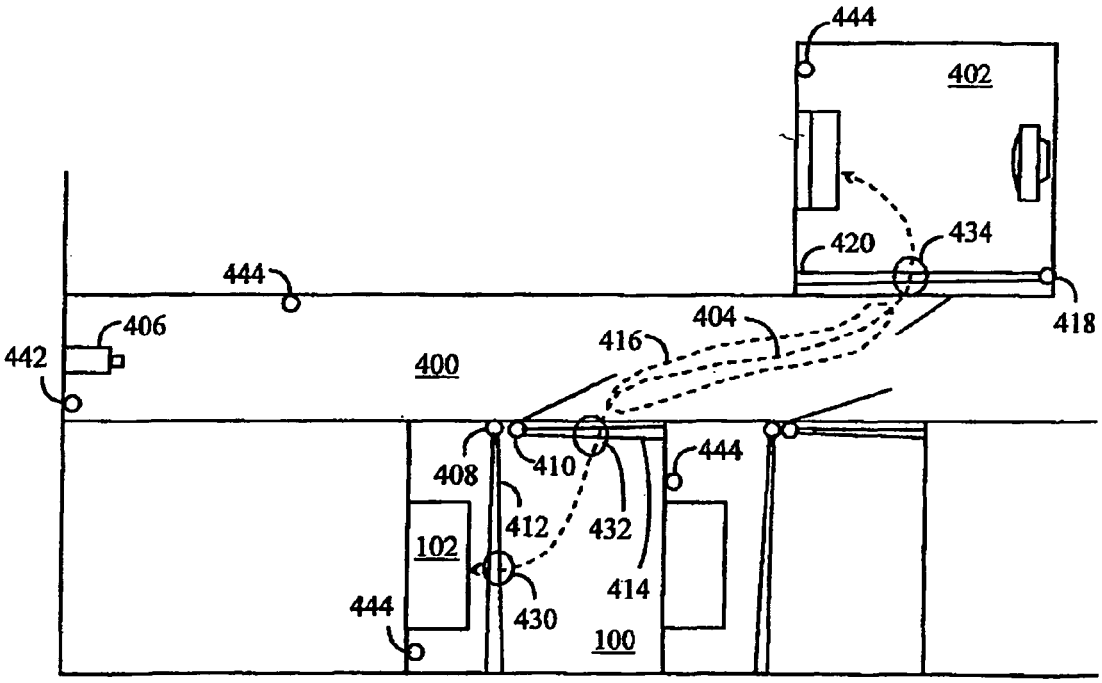
Figure 5:
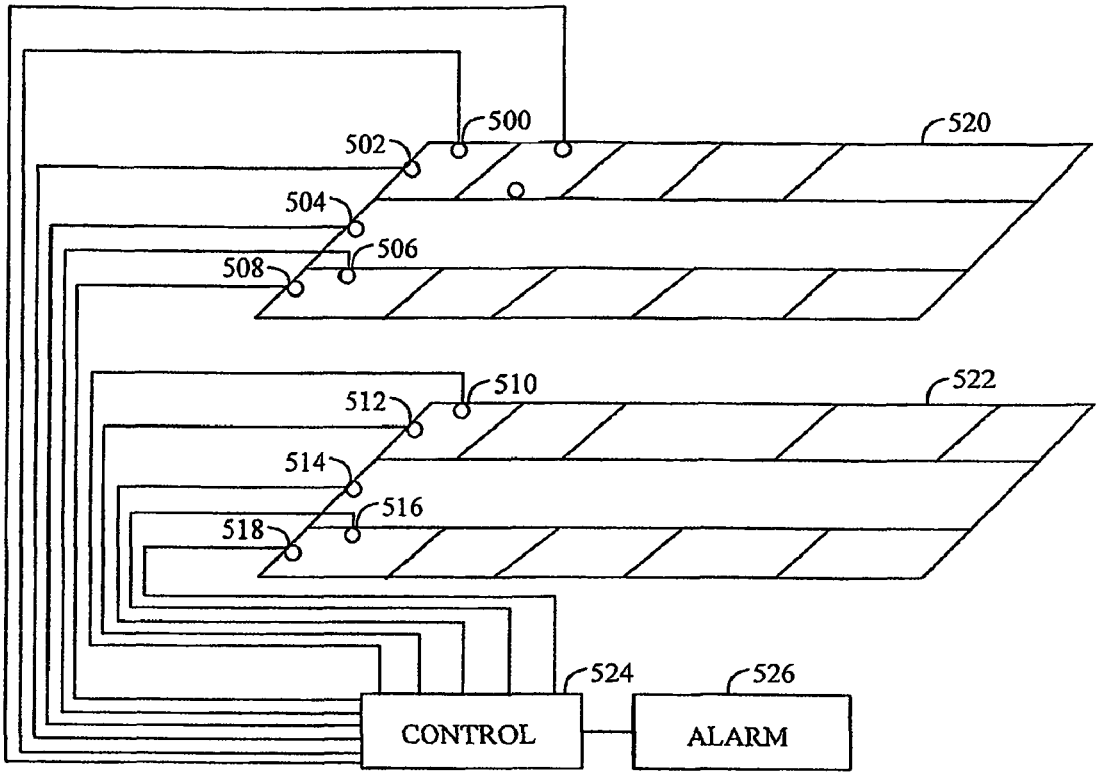
Figure 6:
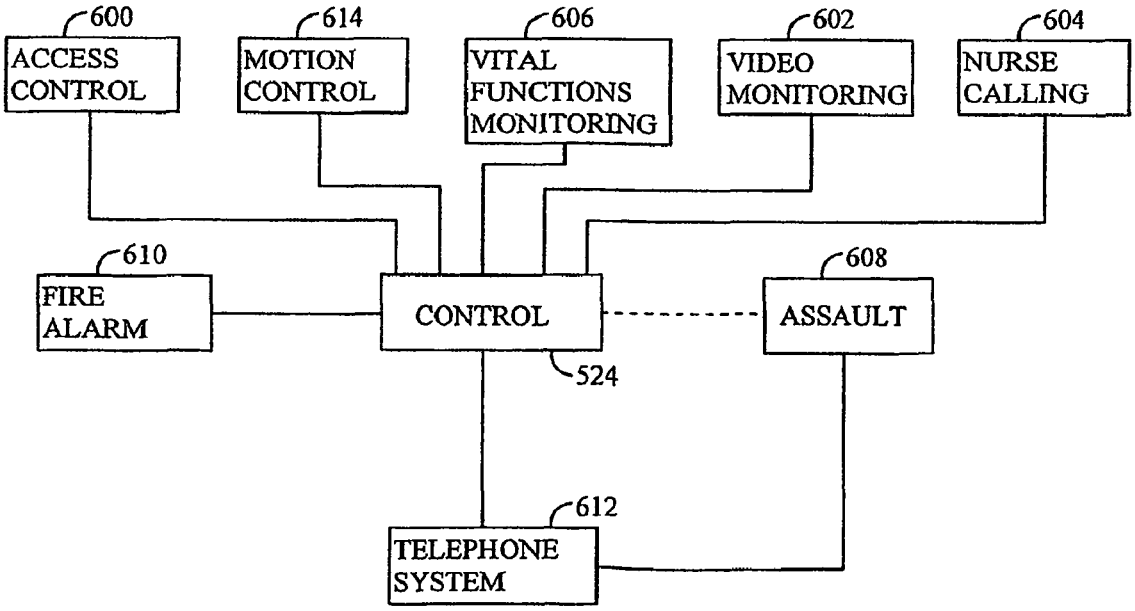
Figure 7A:
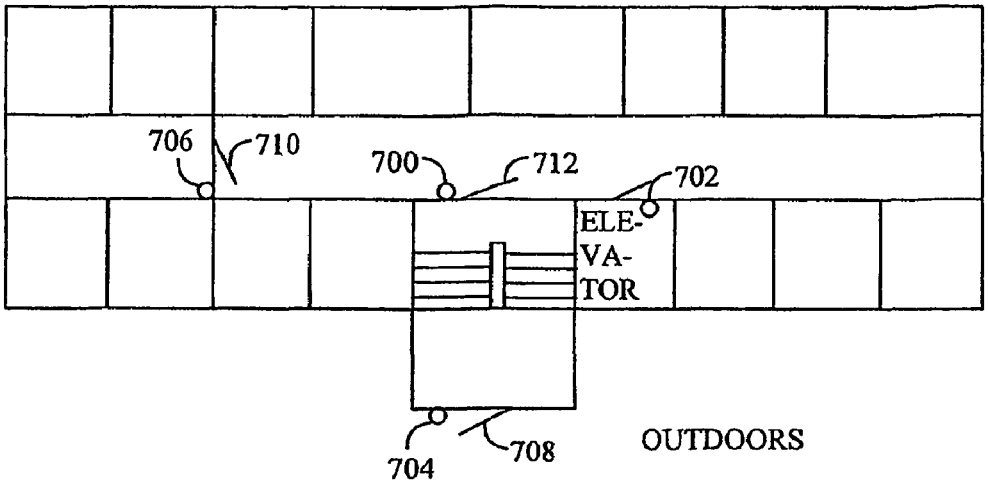
Figure 7B:
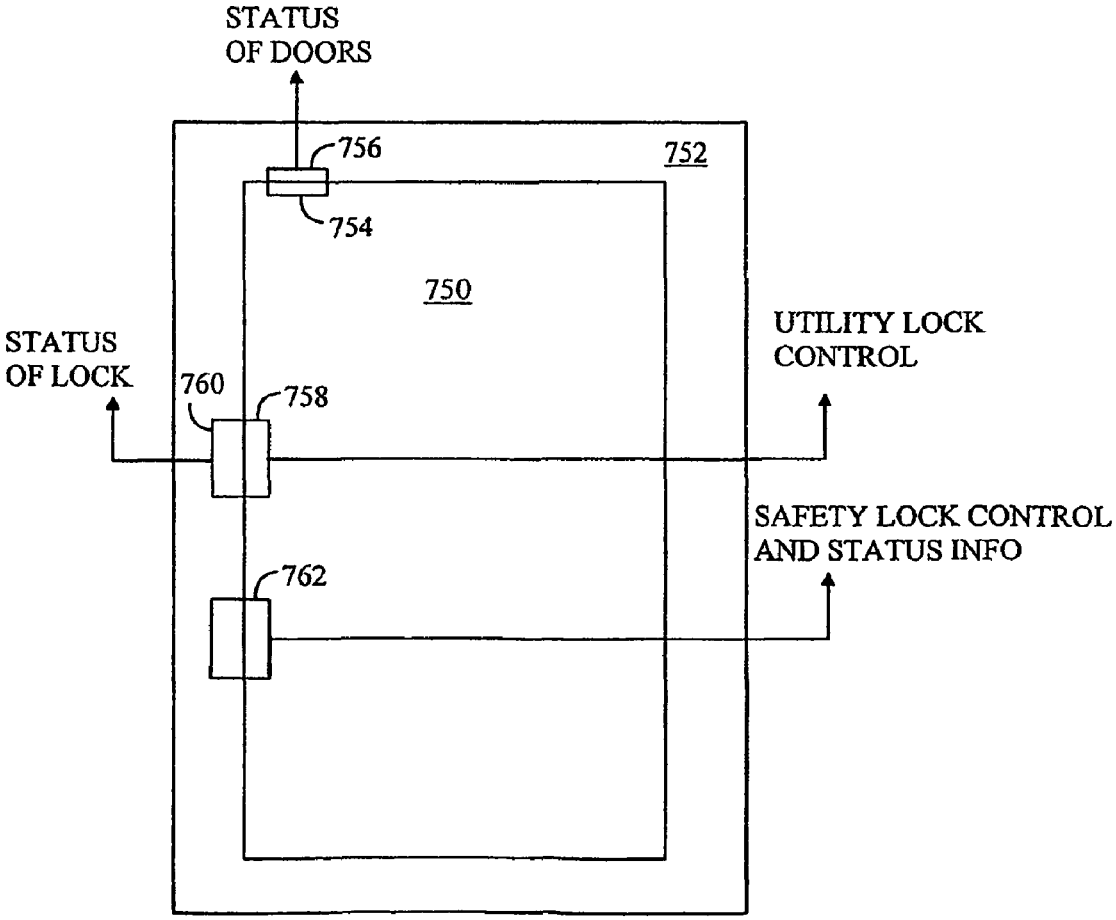

The invention will now be described in greater detail by means of preferred embodiments and with reference to the attached drawings, in which FIG. 1 shows a solution, in which the person being monitored moves from bed to toilet and back, FIG. 2 shows various detection beams, FIG. 3 shows the monitoring of two persons in one room, FIG. 4 shows the monitoring of a person moving from one room to another through a hallway, FIG. 5 shows the connection of motion detectors to the control centre, FIG. 6 shows an integrated guarding system, FIG. 7A shows an access control system, FIG. 7B shows a door arrangement of an access control system, FIG. 8 shows a terminal connected to a nurse calling system, FIG. 9 shows a display of a monitoring system, and FIG. 10 is a flow chart of the method.

DESCRIPTION OF EMBODIMENTS

The present solution can be applied not only to various institutions, but also to homes.

Let us now examine the present solution by means of FIG. 1. Let us assume that the person being monitored sleeps in his or her own room 100 in an initial location 102, in bed, and wakes up to go to the toilet 104, for instance. The person being monitored can take a route 106 from the initial location 102 to a destination location 104, i.e. toilet, and back. To guard the person being monitored and to detect movement in the room 100, there may be at least two motion detectors 108, 110 that may be infrared radiation-based, for instance. In this example, beams 112, 114 of the motion detectors 108, 110 extend in a narrow strip across the room 100. The beams 112, 114 may be high and narrow, approximately 1 m high and from less than a millimeter to dozens of centimeters wide, for instance. The beam may also be as high as it is wide. The beams 112, 114 may be at an elevation of approximately one centimeter to slightly over a metre from the floor, so that a walking or otherwise moving person would encounter them.

The motion detector 108 may be positioned in such a manner that its beam 112 passes right by the bed, i.e. the initial location 102. Thus, if the person being monitored gets up on his or her feet from the side of the bed in the night, s/he encounters the beam 112 and is detected.

The motion detector 110 may be positioned in such a manner that its beam 114 may detect the movement of the person being monitored in another location in the room 100 between the beam 112 and the toilet 104. When the person being monitored moves from the bed to the toilet, s/he encounters both the beams 112 and 114.

When the person being monitored moves from the initial location 102 in the bed to the destination location 104 in the toilet along the route 106, s/he encounters first the beam 112 in a location 116 and is detected. The person being monitored is thus also known to have been in the initial location 102. The location 116 is any intersection of the route between the bed and toilet and the beam 112. Next, the person being monitored encounters the beam 114 in a location 118 and is detected. The location 118 is any intersection of the route between the bed and toilet and the beam 114. His or her locations 116, 118 then form a line of predefined consecutive locations between the initial location 102 and destination location 104.

As can be seen in FIG. 1, it is possible to detect the movement of a person between an initial location and destination location without detecting the person's movement in the initial location and destination location.

When the person being monitored encounters the beam 112 and is detected, the monitoring system initiates a delay, after which an alarm is raised, if at the end of the delay the person is not detected to be in a predefined location that stops the counting of the delay.

In addition, an alarm is raised without delay, if a predefined condition is not met. One predefined condition may be that the person being monitored must detectably encounter the beam 114 within a predefined time after being detected in the location 116 of the beam 112. An additional condition can then also be that the person being monitored must not encounter the beam 112 two times consecutively. However, s/he must encounter the beam 114 two times consecutively to avoid an immediate alarm. These conditions can be understood by the fact that if a person walks from the bed towards the toilet, s/he must not turn back and return to the bed from between the beams 112 and 114, because two consecutive detections from the beam 112 may also mean that the person being monitored has fallen from the bed and tries to get back in it. If this has happened, s/he may also be hurt and need help. When the person being monitored has gone to the toilet, s/he has last been detected in the location 118 of the beam 114. When s/he is returning to the bed, s/he is next detected in the location 118 of the beam, which means that the order of events is as it should be. When the person being monitored is on return detected in the location 116 of the beam 112, s/he can be though to have returned safely to his or her bed. If both the trip to the toilet and the return trip are done within a predefined delay, no alarm is raised. If the second detection related to the trip to the toilet does not occur in the location 116 of the beam 112 within the predefined delay, an alarm is raised, because it is possible that the person being monitored is in trouble.

In general, no beam—with the exception of the last one—should have two consecutive detected encounters. The beam closest to the destination location should, however, have two detectable encounters one after the other.

The predefined delay can also be set in such a manner that the person being monitored should go from the bed to the toilet within the predefined delay. To be specific, the predefined delay refers to a time interval from detection in the beam 112 to detection in the beam 114 in the example of FIG. 1. A new predefined delay can be initiated when the person being monitored exits the toilet, and the person being monitored should within the predefined delay walk back from the toilet to the bed. To be specific, the predefined delay refers in this example to a time interval from detection in the beam 114 to detection in beam 112.

FIG. 2 shows another positioning of motion detectors and beams. Otherwise the use of delays in guarding the person being monitored can be similar to that in the case of FIG. 1. In this solution, the initial location 102 is in bed that has its own partly marked-off space. Movement between this space and any other space can be detected with a motion detector 208 whose beam 212 is narrow. Elsewhere in the room, movement can be detected with a motion detector 210 whose beam 214 is wide and covers the entire room 100 with the exception of the space marked off for the bed. When the person being monitored gets out of bed 102, s/he encounters the beam 212 of the motion detector 208 and is detected. A delay counter is then initiated for a predefined delay. If the person being monitored immediately returns to bed 102, and thus encounters the beam 212 twice in a row, an alarm is raised.

If the person being monitored moves within the area of the beam 214 of the motion detector 210 and is detected, the predefined delay remains in force and s/he may proceed to the toilet 104. If the person being detected is positioned so that s/he has arrived at the beam and remains there, as happens when moving in the beam 214 in the room 100, s/he will be considered detected only once. If the person being monitored exits the beam and then encounters it again, s/he is considered detected twice in this beam. If the person being monitored returns from the toilet in such a manner that s/he is detected first in the beam 214 and then in the beam 212, the delay counter is stopped and the delay no longer measured.

Both in the case of FIG. 1 and FIG. 2, it is possible that only the motion detector 110 or 210 is connected and the motion detector 108 or 208 is not connected to the space being monitored. The person being monitored can then sit up in bed and even walk beside the bed without being detected.

FIG. 3 shows a case where two persons being monitored are in one room. The room then comprises at least three motion detectors 300, 302, 304 to guard the persons. The motion detectors 300 and 304 may be positioned in such a manner that their beams 310 and 314 detect a person getting up from the beds considered as initial locations 306 and 308. A delay can then be started for a visit to the destination location, which is the toilet, regardless of which bed the person being monitored gets up. When either of the persons proceeds to the toilet, the door of the toilet may have a third motion detector 302 whose beam 312 detects the person going in and coming out of the toilet. This way, the movements of the person being monitored can be followed to make sure that the person getting up from the bed actually goes to a location permitted to him or her. Motion detectors 300 to 304 then detect whether the person being monitored returns to the bed or not. If the person being monitored moves in a permitted manner within a predefined time, no alarm is raised. Otherwise, an alarm is raised.

The examples of FIGS. 1, 2, and 3 use a toilet 104, bed 102, and room 100 as examples of spaces where a person being monitored may move. The spaces used in the presented solution may also be totally different rooms and furniture.

FIG. 4 shows one more case for guarding a person being monitored. Let us assume that the person being monitored is permitted to go from his or her room 100 through a hallway 400 to watch television in a television room 402. There may be several similar rooms for persons being monitored along the hallway. The person being monitored may take a route 404. When leaving his or her bed 102, s/he initially encounters a beam 412 of a motion detector 408. Close to the door, s/he encounters a beam 414 of a motion detector 410. The hallway can be monitored with a camera 406, which means a person moving in the hallway is in a beam 416 of the camera 406. After entering the television room 402, the person being monitored encounters a beam 420 of a motion detector 418. In this solution, it may be that when the person being monitored is detected in his or her own room in beam 412, s/he has a predefined time to be detected in the beam 420 of the television room 402. Even though there were a large number of persons being monitored moving in the hallway and rooms, and even though the system cannot identify all moving persons, the delay between the initial location and destination location of each person being monitored provides that if one person being monitored goes into a wrong place (for too long), at least one predefined delay is exceeded and the system raises an alarm.

In tighter monitoring, there may be between the beams a predefined delay within which the person being monitored should be detected in the next beam. Thus, after being detected in the beam 412, the person being monitored must within a predefined delay $t_1$ be detected in the beam 414. If this does not take place, the system will raise an alarm. If the person being monitored has arrived at the beam 414 without an alarm, s/he must within a predefined delay $t_2$ be detected in the hallway 400 in the camera control beam 416 without an alarm. If the person being monitored has arrived at the beam 416 without an alarm, s/he must within a predefined delay $t_3$ be detected in the beam 420. If this happens, s/he has successfully arrived in the television room to watch the television, and no alarm is raised. Otherwise, an alarm is raised. Even though there were a large number of persons being monitored in the hallway and rooms, and even though the system cannot identify all moving persons, the delay between the locations of each person being monitored provides that if one person being monitored goes in to a wrong place (for too long), at least one predefined delay is exceeded and the system quickly raises an alarm.

It is also possible to add to both above alternatives a predefined delay within which a person leaving his or her room, i.e. initial location, should return to the room. This way, it is possible to limit the time of watching the television. After a given time, watching the television can be prevented by setting an alarm to be raised immediately if movement is detected at least in beam 420. This condition can also be set to apply to the hallway 400 between midnight and 6 a.m., for instance.

In the hallways or other places, there may be at least one base station 442 connected to the monitoring system. In addition, the building may have fire alarm sensors 444.

The presented solution can be generally explained using FIG. 4 in such a manner that the movement of each person being monitored can be detected at least in two predefined locations 430, 432, 416, 434 by motion detectors 406, 408, 410, 418 fastened to the building and intended for monitoring each location 430, 432, 416, 434. In addition, the detections allow the detection of a person's movement from the predefined initial location 102 to the predefined destination location 402 within a predefined time without an alarm, if the locations 430, 432, 416, 434 of the person, where the person's movements are detected, form a line of predefined consecutive locations 430, 432, 416, 434. Otherwise, an alarm is raised. In other words, if the line of the person's locations is at some stage 416, 432, 416, 432, an alarm is raised immediately.

FIG. 5 shows a motion detection system for a person being monitored. All motion detectors 500 to 518 in different rooms and floors 520, 522 may be connected to a common control centre 524. The control centre 524 can also direct the motion detectors 500 to 518 into different states. For instance, the motion detectors 500, 502, which may correspond to the motion detectors 108, 110 of FIG. 1, may be in control state 1 that uses a delay before raising an alarm. Thus, the person occupying the room can go to the toilet, for instance.

In control state 2, the delays may be removed, in which case if either of the motion detectors 500, 502 detects movement in the room, an alarm is raised immediately. The alarm means for instance that an alarm unit 526 of the control centre 524 produces a signal perceivable by human senses, which usually is a flashing light or an audio signal or both. The personnel can then initiate action according to instructions related to each type of alarm. The alarm unit 526 can be a wireless terminal or the like that each member of the personnel carries along.

One or more alarm units 526 may be in a fixed position in the control room or in several rooms or hallways in different parts of the building. One or more alarm units 526 may also be wireless and portable, for instance a telephone system terminal. The control unit 524 may raise an alarm only in one or some of the alarm units, if there is more than one alarm unit in use.

As shown in FIG. 6, the above motion detection system 614 for persons being monitored can be combined into one integrated control system entity with at least one of the following: access control system 600, video control system 602, nurse calling system 604, vital functions monitoring system 606, assault alarm system 608, fire alarm system 610, telephone system 612. Each system 600 to 614, of which system 614 is a motion detection system for persons, can be connected to the control centre 524 that has a one- or two-way connection to each system 600 to 614. The control centre 524 can store all events detected by the system into its memory, and they can be later examined on a display or as a report printed on paper. The control centre 524 may continuously display the information on the various systems on a display in the control room. The control centre 524 also takes care of the technical status of each system, for instance malfunctions of sensors and other system parts, weakening of batteries, etc. The operation of the control centre 524 may be based on a computer program that executes actions according to the method.

The access control system 600 is shown in FIG. 7A. Sensors 700 to 706 of the access control system 600 transmit identification information read from the identifiers of persons trying to go out and/or come in to the control centre 524 monitoring the persons moving in the building. The identification is based on contactless identification technology. Only members of the personnel may have identifiers, not the persons being monitored. On the other hand, it may be possible that some of the persons being monitored (those in good condition) also have an identifier. In addition, the control centre 524 prevents outsiders from entering the building without permission by keeping the front door or doors 708 locked all the time.

Access control can also be implemented in such a manner that people cannot exit the wards or parts of the building defined in other ways without a separate identifier, because opening the door 710 of a ward is not allowed without an identifier or possible in the normal way. A person exiting without an identifier causes an alarm.

Access control can also be implemented in such a manner that it is not possible to enter the building without an identifier, but entering the different wards of the building can be done for instance by opening the electric lock of the door 710 by pressing a button or turning the handle, and this requires no identifier. Exiting the wards may, however, require an identifier to open the door 710. In addition to wards, this principle can also be applied to entering a stairway. Then, when a person tries to get from the stairway to a ward, the door 712 opens without an identifier by pressing a button, for instance, but when going from the ward to the stairway, the door 712 does not open without an identifier. This facilitates the movement of the personnel and, at the same time, prevents persons being monitored from straying into wrong places.

If the building has elevators, identifiers may control their movement. A sensor 702 may identify the identifier.

A video control system 602 comprises cameras (as shown in FIG. 4) that are installed in a hallway, for instance. Motion detection can be provided for the field of view of the camera, in which case the camera can be used as a motion detector. Motion detection data and the actual camera image can be transmitted to the control centre 524. The motion detection data of the camera can be used in the same way as the motion detection data contained in other motion detection signals. The camera image can in turn be used in monitoring a room or a hallway.

FIG. 7B shows an access control arrangement at a front door. The door 750 and doorframe 752 may have a magnetic sensor arrangement measuring the status of the door and comprising a part 754 in the door 750 and a part 756 in the doorframe 752. When the door 750 is closed, the part 756 in the doorframe 752 detects the part 754 in the door 750 in its vicinity, whereby the control centre 524 knows from the signal transmitted to it that the door is closed. When the door 750 is open, the part 756 in the doorframe 752 does not detect the part 754 in the door 750, whereby from the signal transmitted to the control centre, the control centre 524 knows that the door is open. An open door may cause an alarm. A utility lock 758 may be electrically controlled. The status of the door lock can be checked with a sensor placed in the latch chamber 760. The door may also have a safety lock, whose status can be checked with a sensor placed in the key cylinder 762. The status of the door and locks can be monitored and/or controlled from the control centre 524.

FIG. 8 shows a terminal of a nurse calling system 604. The customer, resident, or patient, whatever s/he is called, may have a wire or wireless terminal 800 that is functionally connected to the control centre 524. Various alerts or calls can be made with the terminal 800. The customer can then press an alarm button 802, for instance, and the nurse calling system sends an alarm signal to the control centre 524 that may forward the alarm automatically to the nursing staff. In connection with the alarm, the customer may also talk through the terminal with the nurse. The nurses also have the possibility of calling the terminal 800 of the customer. When a nurse arrives at the customer who raised the alarm, s/he can also make additional help requests through the system by pressing the request button 804. The button 804 may also have urgent help request functionality. The button 804 is then pressed for three seconds, for instance, and the alarm is widerspread for instance in a case where resuscitation is needed when the customer is in mortal danger. The alarm can be acknowledged by pressing the button 806, for instance.

A vital functions monitoring system 606 may automatically monitor the vital functions of a patient and automatically transmit an alarm signal to the control centre 524, if a vital function differs from preset limits.

An assault alarm system 608 may function in such a manner that the nurses have with them a wireless telephone system terminal equipped with a personal safety function. The nurse only needs to press one personal safety button in the terminal and the terminal transmits to a base station (e.g. the base station 442 of FIG. 4) in the building an assault signal that the base station forwards to the control centre 524. The control centre 524 may determine and display on a display in the control room the site and the nurse being assaulted. The control room personnel can send a request to other nurses to go to the site, or the control centre 524 may do this automatically.

Each sensor (sensor 444 in FIG. 4) of a fire alarm system 610 can separately transmit a signal indicating a fire to the control centre 524 that then opens the electric locks in the doors of the building. The doors then open manually without an identifier and do not cause an alarm.

The control centre 524 identifies the alarm signals coming from various sites and situations and may handle them differently. In the control room, the various alarms can be presented to the personnel by means of graphical figures and audio signals. The plan of the building with the sites of motion detectors, sensors and cameras can then be displayed. The status of each motion detector, sensor, and camera can be indicated with colours and/or letters.

FIG. 9 shows the statuses of the motion detectors in rooms 300 to 305 by way of example. FIG. 9 shows whether the motion detectors are in use, and if they are, the status of the person being monitored can be determined from them even without alarms. It can be seen that in rooms 300 to 303, the persons are in bed, because the motion detectors close to the beds have last detected motion. In room 304, movement has been detected elsewhere than in the motion detector close to the bed. Thus, this person may be in the toilet. Room 305 shows an alarm.

After an alarm is raised, each member of the personnel or only some of them may receive information on it to their cordless phones acting as terminals. The telephone system may be DECT (Digital Enhanced Cordless Telecommunications) that is connected to the control centre 524. The nurse calling system 604 and telephone system are at least partly the same. The control centre 524 can for instance distribute the alarm only to the personnel of the ward where the alarm was raised, and not to the entire personnel. At the same time, the control centre 524 may transmit information on the type of the alarm as a clear text message and possibly also the site as a graphical presentation. With the terminal, it is also possible to make announcements to each room, floor, or the entire building.

FIG. 10 shows a flow chart of the method. In step 1000, the movement of each person is shown at least at two predefined locations with a motion detector that is fastened to the building and monitors the location. In step 1002, the movement of each person from a predefined initial location to a predefined destination location is detected within a predefined time without raising an alarm, if the detected locations of the person form a line of predefined consecutive locations. Otherwise, an alarm is raised in step 1004.

Even though the invention is described above with reference to examples according to the attached drawings, it is clear that the invention is not limited thereto but may be varied in many ways within the scope of the attached claims.

The invention claimed is:

1. A method for guarding one or more persons inside a building, the method comprising directing, by means of at least two motion detectors fastened to the building, into a room being monitored at least two non-superimposed beams, at least one of which extends in a width of at most dozens of centimeters across the room being monitored;

detecting the movement of each person at least at two separate locations defined by the beams;

observing the movement of each person by means of the detections in a predefined time without raising an alarm, if the detected locations of the person form a line of predefined consecutive locations from a predefined initial location to a predefined destination location;

raising an alarm if this is not the case; and raising an alarm if the person being monitored is not detected twice successively at the destination location.

2. The method as claimed in claim 1, further comprising detecting the movement of the person from the destination location back to the initial location in a predefined time without raising an alarm.

3. The method as claimed in claim 1, further comprising indicating the movement of the person between the initial location and destination location without indicating the person's movement in the initial location and destination location.

4. The method as claimed in claim 1, further comprising raising an alarm if the person being monitored is detected twice successively at the same location excluding detections related to the destination location.

5. The method as claimed in claim 1, wherein to guard the person at least one of the following is also performed in an integrated manner: access control at the doors of the building, video monitoring, nurse calling monitoring, vital functions monitoring, assault monitoring, fire control, transmission of data related to alarms through a cordless phone system to the personnel.

6. A system for guarding one or more persons inside a building, wherein the system comprising at least two motion detectors and a control centre;

each motion detector being fastened to the building and configured to direct into a room being monitored at least two non-superimposed beams in such a manner that at least one of the motion detectors is configured to extend its beam in a width of at most dozens of centimeters across the room being monitored;

each motion detector being configured to indicate the movement of each person at least at two separate locations defined by the beams; and the control centre being configured to observe the movement of each person by means of the detections in a predefined time without raising an alarm, if the detected locations of the person form a line of predefined consecutive locations from a predefined initial location to a predefined destination location, the control centre being configured to raise an alarm if this is not the case, and the control centre being configured to raise an alarm if the person being monitored is not detected twice successively at the destination location.

7. The system as claimed in claim 6, wherein the control centre is configured to detect the person's movement from the destination location back to the initial location in a predefined time without raising an alarm.

8. The system as claimed in claim 6, wherein the motion detectors are configured to indicate the movement of the person between the initial location and destination location without indicating the person's movement in the initial location and destination location.

9. The system as claimed in claim 6, wherein the control centre is configured to raise an alarm if the person being monitored is detected twice successively at the same location excluding detections related to the destination location.

10. The system as claimed in claim 6, wherein at least one of the following is integrated to the control centre: access control system, video monitoring system, nurse calling system, vital functions monitoring system, assault alarm system, fire alarm system, telephone system.

* * * * *